US006502760B2

(12) United States Patent
Keedwell

(10) Patent No.: US 6,502,760 B2
(45) Date of Patent: Jan. 7, 2003

(54) RAIL SUPPORT

(75) Inventor: Michael James Keedwell, Coventry (GB)

(73) Assignee: Coventry University, Covington (GB)

( * ) Notice: Subject to any disclaimer, the term of this patent is extended or adjusted under 35 U.S.C. 154(b) by 0 days.

(21) Appl. No.: 09/734,238

(22) Filed: Dec. 8, 2000

(65) Prior Publication Data

US 2001/0023897 A1 Sep. 27, 2001

(51) Int. Cl.[7] ..... E01C 9/00
(52) U.S. Cl. ..... 238/2
(58) Field of Search ..... 238/2, 27, 382; 104/12, 13

(56) References Cited

U.S. PATENT DOCUMENTS

| | | | | |
|---|---|---|---|---|
| 568,879 | * | 10/1896 | Sheahen | 238/2 |
| 3,756,507 | * | 9/1973 | Hanig et al. | 238/2 |
| 3,877,640 | | 4/1975 | Hemmady | 238/2 |
| 3,878,987 | * | 4/1975 | Uzuka | 104/11 |
| 4,262,845 | | 4/1981 | Lucas et al. | 238/7 |
| 4,451,180 | * | 5/1984 | Duval | 104/12 |
| 4,500,037 | * | 2/1985 | Braitsch et al. | 238/2 |
| 5,060,856 | * | 10/1991 | Ortwein | 238/2 |

FOREIGN PATENT DOCUMENTS

| | | | | |
|---|---|---|---|---|
| DE | 1 534 039 | | 1/1969 | |
| DE | 3144608 | * | 5/1983 | 238/2 |
| DE | 40 11 014 A1 | | 6/1991 | |
| DE | 296 12 240 U1 | | 12/1997 | |
| GB | 1250315 | | 10/1971 | |
| JP | 4-1301 | * | 4/1992 | 238/2 |

* cited by examiner

*Primary Examiner*—Mark T. Le
(74) *Attorney, Agent, or Firm*—Oppenheimer Wolff & Donnelly LLP

(57) ABSTRACT

A supporting system supporting a rail of a rail track above a substrate. The system includes a support having an tipper surface for supporting the rail and a lower surface facing the substrate. The support is maintained between the lower surface and the substrate and, in response to separation of the rail and the substrate, movement of the rail towards the substrate is inhibited.

15 Claims, 4 Drawing Sheets

Section A–A

Section B–B

RAIL SUPPORT

The present invention relates to a rail support.

One of the problems associated with ballasted rail track is the formation of cavities in the ballast immediately underneath the rail track sleepers. This is a serious problem which, if not corrected, can result in deformation of the track and ultimately train derailment.

Current practice is to refill the cavity underneath each sleeper by tamping or "stone-blowing". This is an extremely expensive process which has to be repeated at regular intervals.

The present invention seeks to provide an improved rail support.

The present invention provides a system for supporting a rail of a rail track above a substrate, the system including a support having an upper surface for supporting said rail and a lower surface facing said substrate, and means for maintaining support between said lower surface and said substrate in response to separation of said rail and said substrate and inhibiting movement of said rail towards said substrate.

In a preferred embodiment of a system according to the present invention, the system comprises a support for supporting road or rail vehicles above a prepared ground surface or formation, in the form of two or more parallel continuous beams or rails placed in the direction of travel of the vehicles and resting on and attached to cross members placed at right angles to the beams, the said cross members resting on a substrate comprising ballast or road pavement materials placed above the said prepared ground surface or formation, and the spaces between the said cross members being filled with granular material, the spacing and dimensions of the said cross members in section and the particle size of the said granular material being so selected that the said granular material may flow freely into any gaps which may form between the said cross members and the said ballast or road pavement materials, but not into the voids which are present within the said ballast or road pavement materials thus to compensate for uneven settlement of the said ballast or road pavement materials and to provide a self-levelling support system.

In a particularly preferred embodiment of a system according to the present invention, for use on ballast having a particle size of the order of 50 mm, the cross members have a width of between 120 mm and 290 mm, more preferably 150 mm, and a centre to centre spacing of between 400 mm and 700 mm, more preferably 550 mm. The particle size of the granular material placed between the cross members is preferably between 15 mm and 35 mm, more preferably 20 mm.

The present invention further provides a support for supporting a rail of a rail track above a substrate, the support having an upper surface for supporting said rail and a lower surface facing said substrate, and means for urging said upper and lower surfaces apart in response to separation of said rail and said substrate and inhibiting movement of said first and second surfaces towards one another, thereby to maintain support for said rail on said substrate.

In a preferred form of the invention, the support supports the rail or rails above the substrate between a pair of sleepers, the lower surface of the support bearing on the substrate. Alternatively, the support is placed under the sleeper.

In a further embodiment the support supports the rail or rails on a sleeper which is in turn supported on the substrate, the lower surface of the support bearing on the sleeper.

Advantageously, the support has resilient means biassed to allow movement of said upper and lower surfaces away from one another and to resist return movement of said upper and lower surfaces.

In a preferred embodiment of a support according to the present invention, which is particularly suitable for supporting a rail on a ballast substrate, the support is in the form of a container having an upper surface for supporting the said rail and a lower surface facing the said ballast and containing between the said upper and lower surfaces a suitable granular material which can flow freely as required through perforations in the said lower surface, thus allowing movement apart of said rail and ballast while inhibiting movement of said rail and said ballast towards one another, thereby to maintain support for said rail on said ballast.

In one form of this embodiment of the invention the container replaces the conventional sleeper and supports both rails. Alternatively, the conventional sleeper may be replaced by two containers one supporting each rail.

In a further embodiment the container supports a rail or rails above the ballast between a pair of conventional sleepers.

Advantageously means are provided for recharging the container with granular material as required and a tray is provided underneath the container to separate from the ballast any granular material which passes through the perforated lower surface of the container.

The present invention is further described hereinafter, by way of example, with reference to the accompanying drawings in which.

Figure 8:
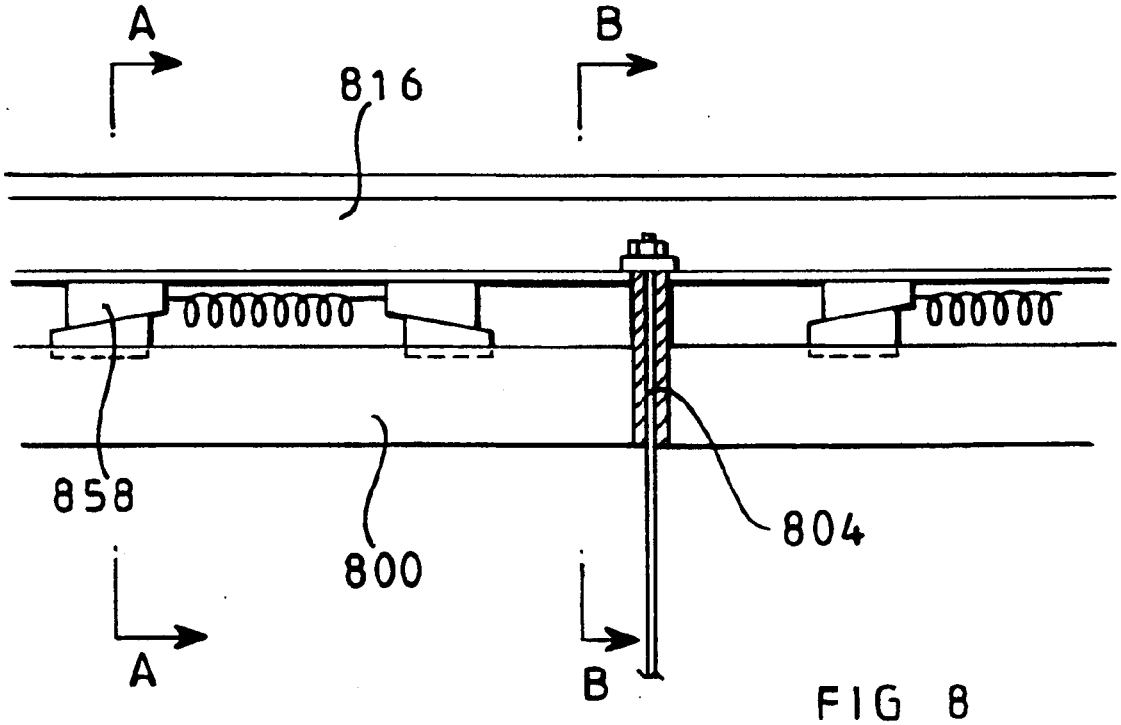
FIG. 8 is a side elevation of part of a rail track showing the rails supported by a further alternative embodiment of a support according to the present invention.
Figure 9:
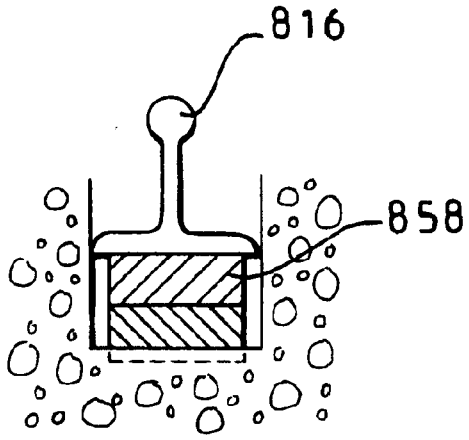
FIG. 9 is a cross-sectional view on A—A of the support of FIG. 8.
Figure 10:
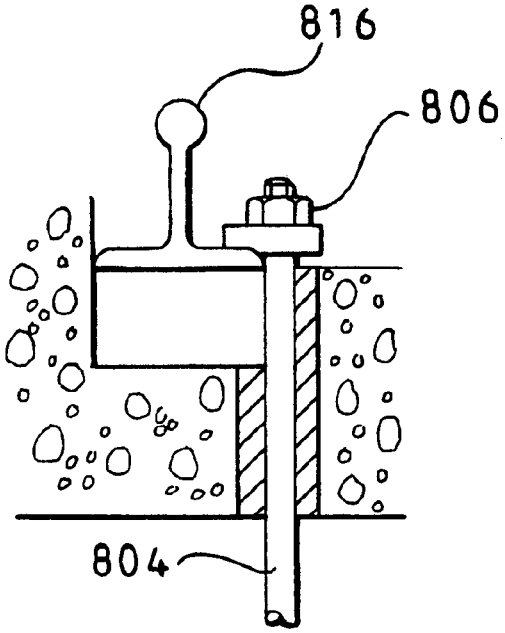

FIG. 10 a cross-sectional view on B—B of the support of FIG. 8 and

Figure 11:
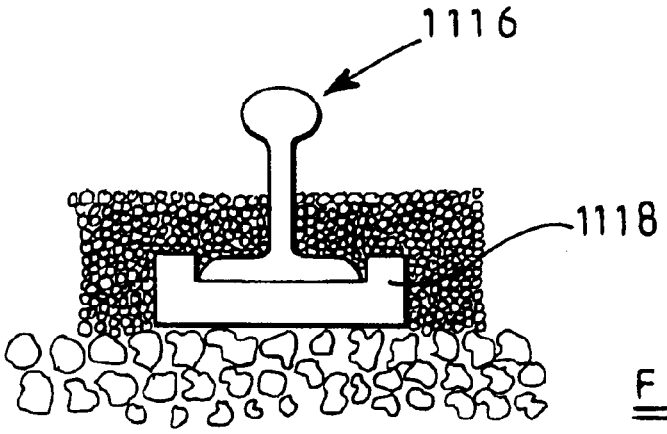

FIG. 11 is a cross sectional view of a further embodiment of a support according to the present invention.

Figure 1:
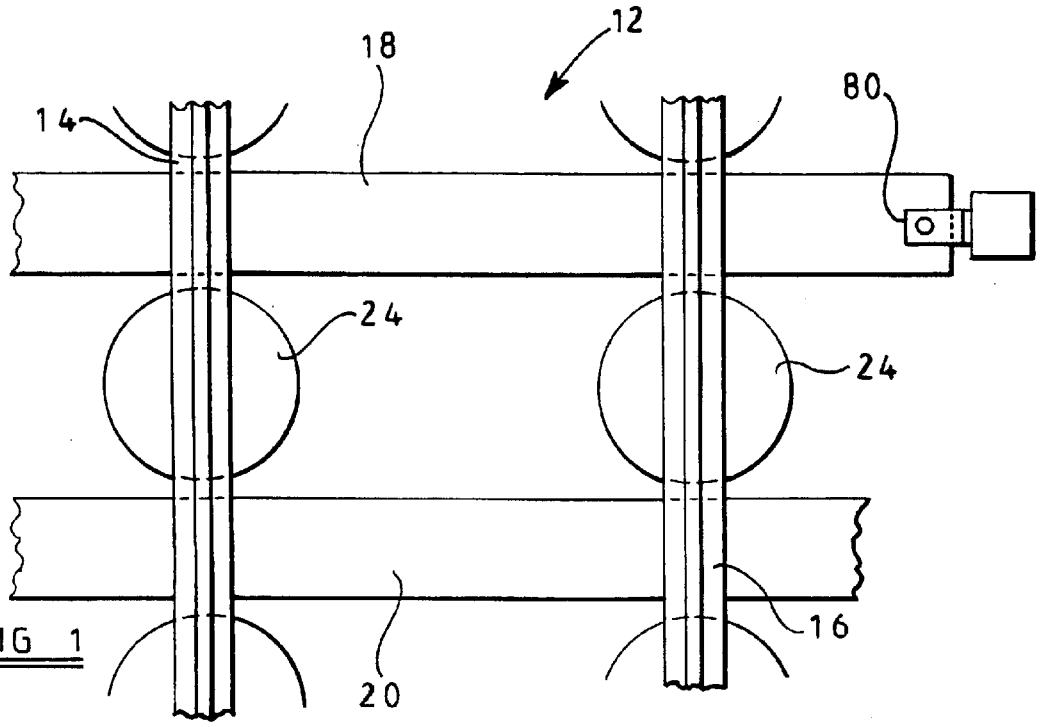
FIG. 1 is a plan view of part of a rail track showing each rail supported by a preferred form of rail support according to the present invention.

Referring firstly, to FIG. 1, this shows a plan view of part of a rail track 12 with two rails 14, 16 supported on sleepers 18, 20. Additional support for the rails 14, 16 is provided by a pair of supports 24 located beneath the rails between the sleepers 18, 20.

It will be appreciated that the supports 24 can be used individually or in pairs.

Figure 2:
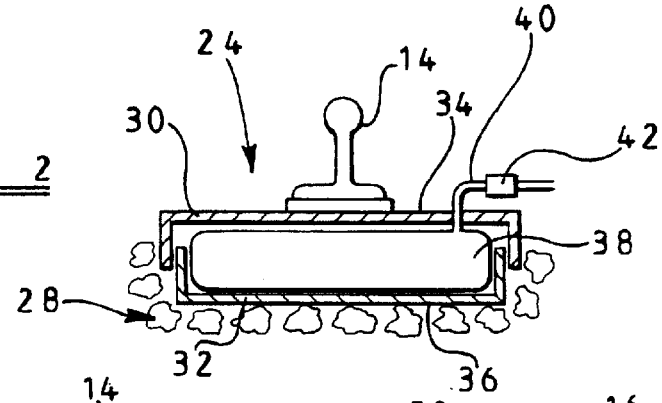
FIG. 2 is an elevation, partly in section, of the support of FIG. 1.

FIG. 2 shows the rail support 24 which supports the left hand rail 14 as seen in FIG. 1 above the rail ballast 28.

The support 24 has upper and lower housing portions 30, 32 with respective upper and lower surfaces 34, 36. The spacing between the upper and lower surfaces 34, 36 is adjustable by adjustment of the relative positions of the housing portions 30, 32. The latter are conveniently slidably engaged with one another to enable the upper and lower portions to slide towards and away from one another. Ideally, the engagement is a simple telescopic engagement.

As can be seen, the upper and lower housing portions 30, 32 are conveniently cylindrical i.e. circular in plan, although any suitable shape may be used.

A flexible container 38, conveniently in the form of a bag of suitable material is contained within the support 24 so that it supports the upper portion 30 above the lower portion 32. Whilst the container 38 is ideally flexible, it will be appreciated that resilient materials or a concertina or telescopic form of container may be used. It is however, important that the container should be a fluid tight container for the reasons explained below.

The container 38 contains a hydraulic fluid and has an inlet/outlet pipe or conduit 40 which contains a non-return valve 42. The conduit 40 can be connected to a source of hydraulic fluid which is at a higher pressure than atmospheric pressure.

In use, as trains pass along the rail track 12, each rail is depressed and the ballast 28 is compacted resulting in cavities being formed in the ballast beneath the sleepers and the supports.

After the train has passed the rail rises again leaving a space between the rail and the support 24 or a cavity in the ballast beneath the support 24. The hydraulic fluid which is under pressure in the hydraulic fluid source is forced through the non-return valve 42 into the container 38 to expand the container and move the upper and lower portions 30, 32 apart to take up the space formed between the rail 14 and the support 24 or by the cavity in the ballast 28. The support 24 thus maintains the rail 14 supported at its desired level, since the fluid in the container is not compressible.

As an alternative to an in-situ source of pressurised hydraulic fluid, the container 38 can be filled from a separate hydraulic fluid source which is used by an operator who checks the tracks and adds hydraulic fluid to containers 38 where necessary.

Figure 3:
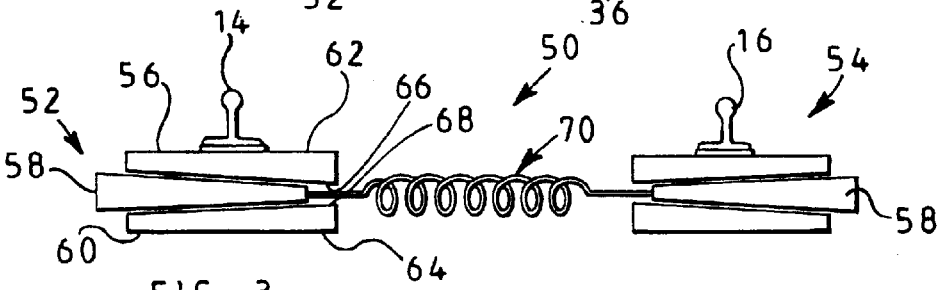
FIG. 3 is an elevation of a second embodiment of support according to the present invention.

Referring now to FIG. 3, this shows a further embodiment of support 50 according to the present invention. The support 50 has two support devices 52, 54 which support the rails 14, 16 respectively. Since the support devices are substantially identical, only the left hand device is described.

The support device 52 has three wedge-shaped members 56, 58 and 60. The upper member 56 has an upper surface 62 which lies generally flat and supports the rail 14. The lower member 60 has a lower surface 64 which is supported on ballast.

The two facing surfaces 66, 68 of the members 56, 60 provide a wedge-shaped gap which tapers inwardly towards the space between the rails 14, 16. The middle member 58 locates within this wedge-shaped space with upper and lower surfaces that bear on the surfaces 66, 68.

The wedge 58 is connected to the wedge 58 of the right hand support device by way of a resilient mechanism 70 which biases the wedges 58 towards one another. The resilient mechanism 70 is conveniently a coil spring which is maintained under tension. The spring can be wound about a former (not shown) and is ideally contained within a protective cover which may in its simplest form be a tube (not shown).

When a train passes over the support devices 52, 54 compacting the ballast and causing one or more cavities to be formed beneath either or both of the support devices, once the train has passed the rail or rails will rise back to their original levels. The resilient member 70 will then act to draw the wedges 58 towards one another to cause the upper and lower surfaces 62, 64 of the support devices to move apart and take up any slack which has been, formed between the rail or rails and the ballast.

Advantageously, the upper member 56 of each support is secured to the rail 14 to prevent its being dislodged from underneath the rail. Ideally, the upper and lower members 56, 60 are interconnected in some manner to prevent their relative movement other than towards and away from one another. Conveniently, they could be contained within a housing or part housing to prevent their lateral movement when the resilient means 70 draws the wedges 58 towards one another.

A level adjustment screw 80 fixed to a bracket which is in turn secured to the ground surface, conveniently by way of a short pile, can be used to show whether or not the level of the sleeper and thus the rails has dropped. This can be used to indicate whether or not the support device of FIG. 2 requires additional hydraulic fluid or the support devices of FIG. 3 have reached the full extent of their adjustment or, perhaps, have malfunctioned.

Additionally, if the fluid pressure in the case of the support device of FIG. 2 or the spring tension in the case of the device of FIG. 3 were sufficiently great to overcome the combined weight of the rails and sleepers the gap between the latter and the level adjustment screw 80 would always be reduced to zero.

It is also possible that a support could be positioned between the sleeper and the rails in order to support the rails on a sleeper. This would operate in exactly the same way as described above since the sleeper, being supported on the ballast, would sink relative to the rails with the formation of cavities in the ballast beneath the sleeper.

Figure 4:
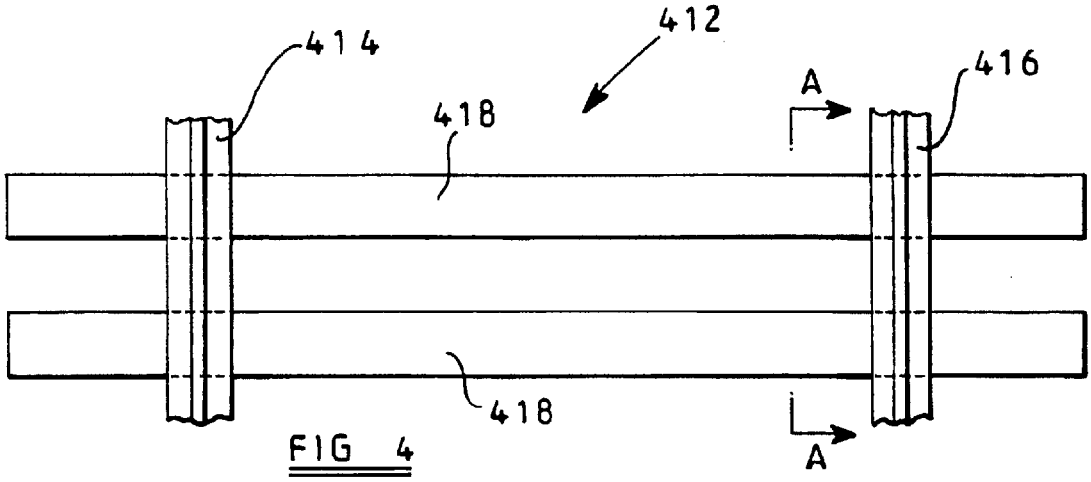
FIG. 4 is a plan view of part of a rail track showing the rails attached to cross members according to the present invention.
Figure 5:
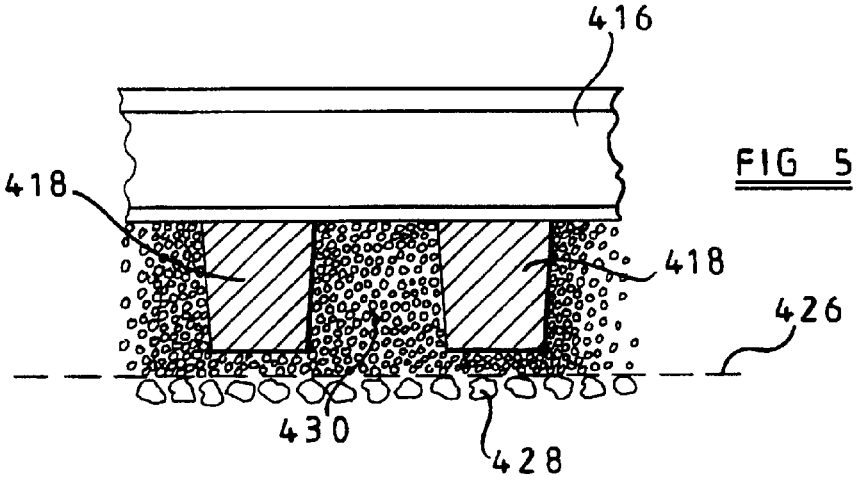
FIG. 5 is a cross-sectional view on A—A of the cross members of FIG. 4.

In the alternative embodiment shown in FIG. 4, this shows a plan view of part of a rail track 412 with two rails 414, 416 supported on and attached to cross members 418. FIG. 5 shows, in section, two cross members 418 which support the rails 414,416 above the ballast 428.

It will be seen that the cross members 418 are much narrower in section than conventional railway sleepers and that the spaces between the cross members are filled with granular material 430 some of which has flowed under the cross members 418. The optional mesh 426 separates the ballast 428 from the granular material 430. In the absence of the mesh any granular material present below cross members 418 would rest directly on the ballast 428.

In use, as a train passes along the rail track 412 the ballast 428 may become compacted and the rails depressed. When the train has passed the rail rises again increasing the gap between the rails and the ballast. Because the cross members are attached to the rails, when the rails rise the cross members will rise also allowing granular material to flow under the cross members and hence prevent the formation of cavities under the cross members 418. Hence the cross members 418 and the granular material 430 together form a self-levelling support system.

Figure 6:
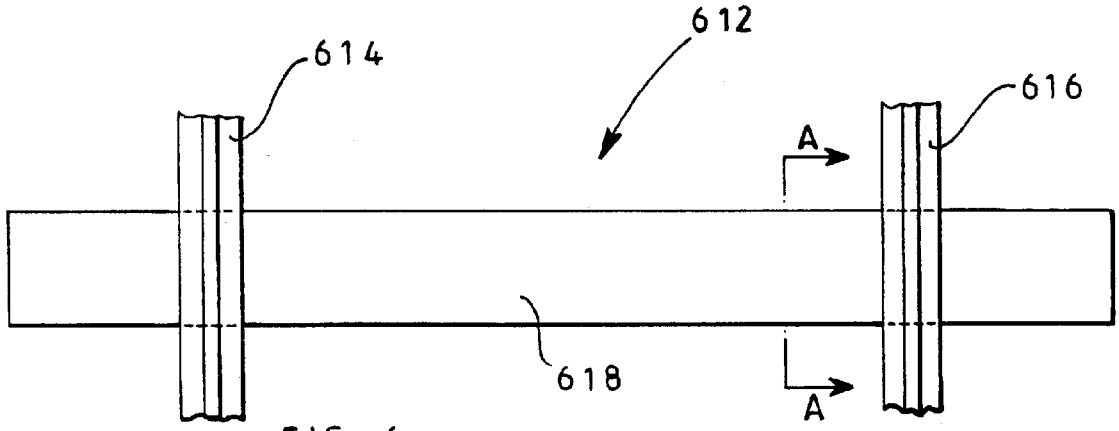
FIG. 6 is a plan view of part of a rail track showing the rails supported by an alternative embodiment of a support according to the present invention.
Figure 7:
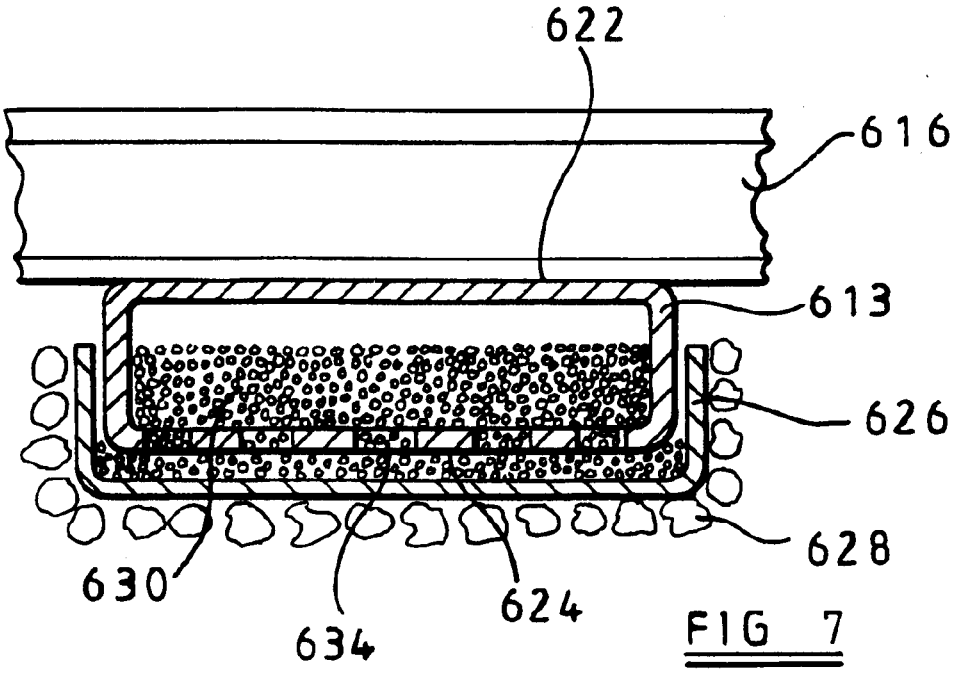
FIG. 7 is a cross-sectional view on A—A of the support of FIG. 6.

In a further alternative embodiment, FIG. 6 shows a plan view of part of a rail track 612 with two rails 614, 616 supported on support 618. Support 618 is in the form of a hollow box beam closed at each end 620. It replaces the conventional timber, concrete or steel sleeper. FIG. 7 shows, in section, the rail support 618 which supports the rails 614,616 above the ballast 628.

It will be seen that support 618 contains granular material 630 some of which has passed through the perforations 634 in the lower surface 624 of the support into the tray 626. The rails 614,616 are attached to the upper surface 622 of the support 618 and the lower surface 624 of the support 618 rests on the granular material 630 which has passed through the perforations 634 in the lower surface 624 of the support. The optional tray 626 separates the ballast 628 from the granular material 630. In the absence of the tray any granular material present below support 618 would rest directly on the ballast 628.

In use, as a train passes along the rail track 612 the ballast 628 may become compacted and the rails depressed. When the train has passed the rail rises again increasing the gap between the rails and the ballast. Because the support is attached to the rails, when the rails rise the support will rise also allowing granular material to flow through the perforations 634 in the lower surface of the support and hence prevent the formation of a cavity under the support. Any granular material which has flowed through the perforations will be compacted by the weight of the next train and hence is unable to flow back up through the perforations. The support 618 thus maintains the rails 614,616 supported at their desired level without the need for tamping or "stone-blowing" operations.

Advantageously, the upper surface 622 of the support 618 is provided with closable access holes (not shown) to enable the support to be recharged with granular material as required. An alternative design (not shown) supports only one of the rails 614,616 and while being similar in all other respects to the support 618 described above might be circular or square in plan, although any suitable shape may be used.

It is also possible that the support 618 or the alternative design previously described could be placed in the space between any two conventional timber, concrete or steel sleepers. In the embodiment shown in FIG. 8, a rail 816 is supported on a substrate 800 in the form of a concrete slab. The support device operates in a similar manner to the support device of FIG. 3, with the wedge of FIG. 3 replaced by the wedge 858 of FIG. 8. As can be seen from FIG. 10, a height adjustment rod 804 is anchored at depth below the slab 800 and is provided with an adjustment nut 806 for initial adjustment of the height of the rail above the substrate.

Alternatively other resilient means of support are envisaged, such as that shown in FIG. 2 or springs (not shown).

In the embodiment shown in FIG. 11, a rail 1116 is supported on a sleeper 1118 which extends along the length of the rail, rather than as a cross member as in the embodiments disclosed earlier. The longitudinal sleeper is supported on a ballast substrate, and the self levelling mechanism operates in a similar manner to that of FIG. 4.

What is claimed is:

1. A system for supporting a rail of a rail track above a prepared ground surface, the system comprising:

a ballast substrate disposed above the prepared ground surface;

a plurality of spaced support members each having an upper surface for supporting said rail and a lower surface facing said substrate; and granular material disposed adjacent said support members;

wherein the system is arranged so as to allow the granular material to flow into any gaps formed between said support members and said substrate in response to separation of said rail and said substrate, but not into voids which are present within said substrate, thereby to support said rail and substantially inhibit movement of said rail towards said substrate.

2. A system as claimed in claim 1 wherein each said support member comprises a conventional cross member or sleeper placed transversely to said rails and wherein said granular material is disposed in the spaces between said cross members.

3. A system as claimed in claim 1 wherein each said support member is placed underneath and parallel to said rails.

4. A system according to claim 2 characterized in that the cross members have a width of between 120 mm and 290 mm.

5. A system according to claim 4 characterized in that the cross members have a width of 150 mm.

6. A system according to claim 2 characterised in that the cross members have a center to center spacing of between 400 mm and 700 mm.

7. A system according to claim 6 characterised in that the cross members have a center to center spacing of 55 mm.

8. A system according to claim 2 characterised in that the particle size of the granular material placed between the cross members is between 15 mm and 35 mm.

9. A system according to claim 8 characterized in that the particle size of the granular material placed between the cross member is 20mm.

10. A system as claimed in claim 1 wherein each said support member is in the form of a container having perforations in the lower surface thereof and wherein said granular material is disposed within said container and is arranged to flow through said perforations in response to separation of said rail and said ballast, thereby permitting movement apart of said rail and said ballast while substantially inhibiting movement of said rail and said ballast towards one another, thereby to maintain support for said rail on said ballast.

11. A system as claimed in claim 10 wherein the container supports both rails.

12. A system as claimed in claim 10 comprising two containers, each being adapted to support a respective rail of said rail track.

13. A system according to claim 10 wherein said containers are adapted to support a rail or rails above the ballast between a pair of conventional sleepers.

14. A system according to claim 10 to 13 wherein said container is adapted to operate with means for recharging the container with granular material.

15. A system as claimed in any of claims 10 to 13 further comprising a tray disposed beneath the container to separate from the ballast any granular material which passes through said perforations.

* * * * *